US008858874B2

(12) United States Patent
Tin et al.

(10) Patent No.: US 8,858,874 B2
(45) Date of Patent: Oct. 14, 2014

(54) TERNARY NICKEL EUTECTIC ALLOY

(75) Inventors: Sammy Tin, Chicago, IL (US); Robert J Mitchell, Nottingham (GB)

(73) Assignee: Rolls-Royce PLC, London (GB)

( * ) Notice: Subject to any disclaimer, the term of this patent is extended or adjusted under 35 U.S.C. 154(b) by 1150 days.

(21) Appl. No.: 12/230,561

(22) Filed: Sep. 2, 2008

(65) Prior Publication Data

US 2009/0136381 A1 May 28, 2009

Related U.S. Application Data

(60) Provisional application No. 60/996,544, filed on Nov. 23, 2007.

(51) Int. Cl.
*C22C 19/05* (2006.01)

(52) U.S. Cl.
CPC ..... *C22C 19/05* (2013.01)
USPC ..... 420/445

(58) Field of Classification Search
USPC ..... 420/445
See application file for complete search history.

(56) References Cited

U.S. PATENT DOCUMENTS 3,124,452 A 3/1964 Kraft
3,554,817 A 1/1971 Thompson
3,564,940 A 2/1971 Thompson et al.
3,671,223 A 6/1972 Thompson et al.
3,767,479 A 10/1973 Tarshis
3,793,010 A 2/1974 Lemkey et al.
4,126,495 A * 11/1978 Ghosh ..... 148/428
2002/0057984 A1 * 5/2002 Speidel et al. ..... 420/445

FOREIGN PATENT DOCUMENTS

EP 1 193 321 B1 10/2003
JP 64087731 A * 3/1989 ..... C22C 1/04

OTHER PUBLICATIONS

Oct. 9, 2012 European Search Report Issued in Application No. EP 08 25 3408.
R.W. Salkeld et al., "Precision Casting of $\gamma/\gamma^1 + \delta$ Eutectic Solid Turbine Blades," Conference on in Situ Composites, vol. 3, Jan. 1, 1979, pp. 280-291.
A.D. Cetel et al., "Component Evaluation and Engine Demonstration of $\gamma/\gamma^1 - \delta$ D.S. Eutectic Solid Turbine Blades," Conference on in Situ Composites, vol. 3, Jan. 1, 1979, pp. 292-302.

* cited by examiner

*Primary Examiner* — Rebecca Lee
(74) *Attorney, Agent, or Firm* — Oliff PLC

(57) ABSTRACT

A ternary nickel eutectic alloy consisting of 4.5 to 11 wt % chromium, 1 to 6 wt % cobalt, 1 to 4 wt % aluminum, 0 to 1.5 wt % titanium, 0 to 3 wt % tantalum, 16 to 22 wt % niobium, 0 to 3 wt % molybdenum, 0 to 4 wt % tungsten, 0 to 1 wt % hafnium, 0 to 0.1 wt % zirconium, 0 to 0.1 wt % silicon, 0.01 to 0.1 wt % carbon, 0 to 0.01 wt % boron and the balance nickel plus incidental impurities.

13 Claims, 3 Drawing Sheets

TERNARY NICKEL EUTECTIC ALLOY

This nonprovisional application claims the benefit of U.S. Provisional Application No. 60/996,544, filed Nov. 23, 2007.

The present invention relates to a ternary nickel eutectic alloy.

Conventionally high pressure compressor discs and/or high pressure turbine discs of gas turbine engines comprise high strength nickel base superalloys. These high strength nickel base superalloys are highly alloyed with high levels of refractory elements to enhance strength and precipitate a high volume fraction of gamma prime phase strengthening precipitates into the gamma phase. The grain structure of these highly alloyed nickel base superalloys has been designed to optimise strength and low cycle fatigue performance and/or resistance to fatigue crack growth and creep deformation by the control of heat treatment parameters.

The high temperature strength in highly alloyed nickel base superalloys is primarily due to the high levels of refractory alloying additions coupled with precipitate strengthening by the presence of high volume fractions of the intermetallic gamma prime phase precipitates in the overall microstructure, e.g. gamma phase. As the overall level of refractory alloying elements has increased in these nickel base superalloys, the microstructure has become thermodynamically unstable, such that during operation micro-structural changes occur which reduce mechanical performance.

Future gas turbine engine turbine discs and/or compressor discs will be required to operate at higher temperatures and/or higher stresses and the existing nickel base superalloys may be unable to meet these future requirements.

Accordingly the present invention seeks to provide a novel ternary nickel eutectic alloy.

Accordingly the present invention provides a ternary nickel eutectic alloy consisting of 4.5 to 11 wt % chromium, 0 to 6 wt % cobalt, 1 to 4 wt % aluminium, 0 to 1.5 wt % titanium, 0 to 3 wt % tantalum, 16 to 22 wt % niobium, 0 to 3 wt % molybdenum, 0 to 4 wt % tungsten, 0 to 1 wt % hafnium, 0 to 0.1 wt % zirconium, 0 to 0.1 wt % silicon, 0.01 to 0.1 wt % carbon, 0 to 0.01 wt % boron and the balance nickel plus incidental impurities.

Preferably the ternary nickel eutectic alloy consists of 5 to 10 wt % chromium, 0 to 6 wt % cobalt, 1 to 3 wt % aluminium, 0 to 1.5 wt % titanium, 0 to 3 wt % tantalum, 18 to 22 wt % niobium, 0 to 3 wt % molybdenum, 0 to 4 wt % tungsten, 0 to 1 wt % hafnium, 0 to 0.1 wt % zirconium, 0 to 0.1 wt % silicon, 0.01 to 0.1 wt % carbon, 0 to 0.01 wt % boron and the balance nickel plus incidental impurities.

Preferably the ternary nickel eutectic alloy consists of 5.5 to 9.5 wt % chromium, 0 to 6 wt % cobalt, 1 to 2.5 wt % aluminium, 0 to 1.5 wt % titanium, 0 to 3 wt % tantalum, 18 to 22 wt % niobium, 0 to 3 wt % molybdenum, 0 to 4 wt % tungsten, 0 to 1 wt % hafnium, 0 to 0.1 wt % zirconium, 0 to 0.1 wt % silicon, 0.01 to 0.1 wt % carbon, 0 to 0.01 wt % boron and the balance nickel plus incidental impurities.

The alloy may consist of 6.0 wt % chromium, 2.5 wt % aluminium, 20.5 wt % niobium, 0.01 wt % carbon and the balance nickel plus incidental impurities.

The alloy may consist of 6.0 wt % chromium, 2.5 wt % aluminium, 3 wt % tantalum, 18 wt % niobium, 0.03 wt % carbon, 0.005 wt % boron and the balance nickel plus incidental impurities.

The alloy may consist of 9.1 wt % chromium, 1.0 wt % aluminium, 20.1 wt % niobium, 0.06 wt % carbon and the balance nickel plus incidental impurities.

The alloy may consist of 5.9 wt % chromium, 2.5 wt % aluminium, 0.2 wt % titanium, 2.5 wt % tantalum, 19.5 wt % niobium, 0.03 wt % carbon, 0.005 wt % boron and the balance nickel plus incidental impurities.

The alloy may consist of 5.9 wt % chromium, 2.5 wt % aluminium, 2.5 wt % tantalum, 22.0 wt % niobium, 0.03 wt % carbon, 0.005 wt % boron and the balance nickel plus incidental impurities.

The alloy may consist of 5.6 wt % chromium, 2.3 wt % aluminium, 2.2 wt % tantalum, 20.0 wt % niobium, 1.6 wt % tungsten, 0.03 wt % carbon, 0.005 wt % boron and the balance nickel plus incidental impurities.

Preferably the ternary nickel eutectic comprising gamma phase, gamma prime phase and delta phase.

Preferably the delta phase and the gamma phase forming lamellar structures and the gamma prime phase forming discrete precipitates in the gamma phase.

Preferably the ternary nickel eutectic comprises 28 to 45 vol % delta phase precipitates and 30 to 35 vol % gamma prime phase precipitates.

The present invention will be more fully described by way of example with reference to the accompanying drawings in which:—

Figure 1:
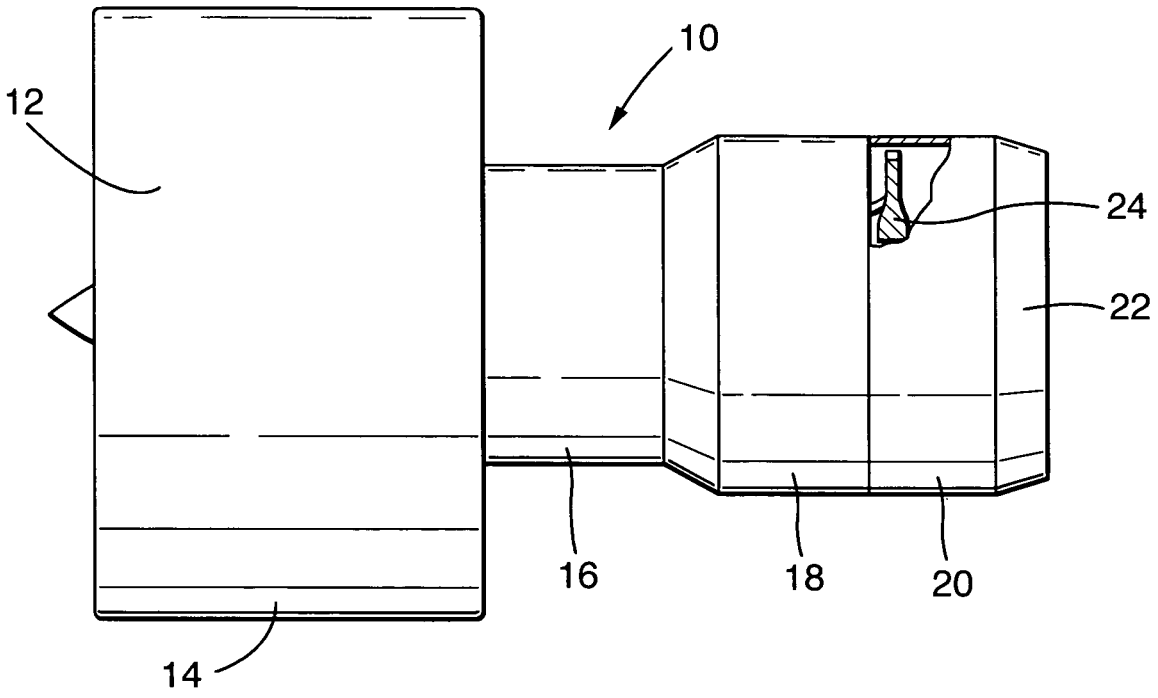
FIG. 1 shows a turbofan gas turbine engine having a turbine disc comprising a ternary nickel eutectic alloy according to the present invention.

A turbofan gas turbine engine 10, as shown in FIG. 1, comprises in axial flow series an inlet 12, a fan section 14, a compressor section 16, a combustion section 18, a turbine section 20 and an exhaust 22. The turbofan gas turbine engine 10 is quite conventional and will not be discussed further.

Figure 2:
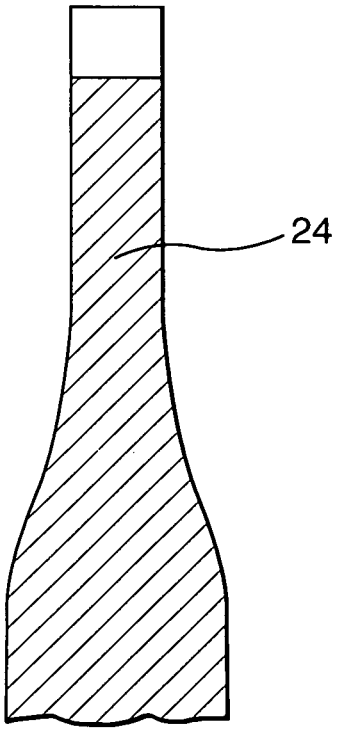
FIG. 2 shows an enlarged view of turbine disc comprising a ternary nickel eutectic alloy according to the present invention.

The turbine section 20 comprises one or more turbine discs 24, shown more clearly in FIG. 2, comprising a ternary nickel eutectic alloy according to the present invention.

The ternary nickel eutectic alloy according to the present invention is a pseudo ternary nickel eutectic alloy and is based on the nickel-aluminium-chromium-niobium system. A eutectic is a mixture of two or more phases at a composition that has the lowest melting point, and where the phases simultaneously crystallise from molten solution at this temperature. The proper ratio of phases to obtain a eutectic is identified by the eutectic point on a phase diagram. Typically solid products of a eutectic transformation are often identified by their lamellar structure. One of the features of eutectic alloys is their sharp melting point.

The microstructures of ternary eutectic alloys derived from the nickel-aluminium-chromium-niobium system are strengthened by high volume fractions of both gamma prime and delta phase precipitates. The increased volume fraction of intermetallic precipitates provides a higher degree of strengthening and enables the strength to be retained even at elevated temperatures when compared to conventional gamma and gamma prime phase nickel base superalloys. Unlike highly alloyed nickel base superalloys that may exhibit thermodynamic microstructural instabilities after long term exposure to high temperatures, the microstructure of ternary eutectic alloys remains stable up to temperatures approaching the melting point of the ternary eutectic alloy.

Both the gamma prime phase and the delta phase are ordered intermetallic phases that possess high APB energies which are highly resistant to deformation.

Ternary eutectic alloys based on gamma, gamma prime and delta phases exist over a limited range of compositions here the ratios of Ni to Al and Ni to Nb are carefully controlled. Unlike typical nickel base superalloys where heat treatments are used to control the morphology, shape and distribution of the precipitates, the phases in ternary eutectic alloys form simultaneously during solidification and remain stable throughout the temperature range. Depending on the composition and solidification conditions the delta phase and gamma phase form lamellar structures, while the gamma prime phase forms as discrete precipitates in the gamma phase. The composite microstructure of the ternary eutectic alloy forms in situ during solidification and provides a much higher degree of strength than conventional nickel base superalloys and the ternary eutectic alloys are suitable for high temperature applications, such as in turbine of gas turbine engines.

The present invention comprises a novel nickel base superalloy that forms composite gamma-gamma prime-delta microstructures during solidification or after powder processing. Typically gamma prime phase forms a discontinuous phase within the delta phase in a lamellar structure. Typically the composition of the gamma prime phase is $Ni_3Al$, whereas the composition of the delta phase is $Ni_3Nb$. The gamma prime forming elements, such as titanium and tantalum may be substituted for aluminium for certain ternary eutectic alloy compositions to further enhance strength. Chromium additions are introduced to enhance resistance to hot corrosion.

These ternary eutectic alloys may be processed using techniques common to those for advanced polycrystalline nickel base superalloys used for turbine discs. The ternary eutectic alloys may be produced by cast and wrought methods through appropriate selection of process parameters, including heat treatment. Furthermore, the ternary eutectic alloys may be produced by powder metallurgy.

These ternary eutectic alloys based on gamma-gamma prime-delta system have much higher strengths than conventional nickel base superalloys and offer substantially higher temperature capability than conventional nickel base superalloys. The high volume fractions of delta and gamma prime phases form an in-situ composite microstructure, which has high tensile strength and high creep strength. The microstructure of these ternary eutectic alloys is thermodynamically stable and is not susceptible to the precipitation of deleterious topologically close packed (TCP) phases or degradation at elevated temperatures. Nickel base superalloys are highly alloyed and contain elevated levels of refractory elements and require processing by costly powder metallurgical techniques to avoid solidification induced defects. These ternary eutectic alloys may potentially be processed by conventional cast and wrought techniques. The absence of dense refractory elements, e.g. rhenium, also lowers the cost of the ternary eutectic alloys.

The overall advantages of ternary eutectic alloys are minimum processing required for optimum uniaxial mechanical properties. The ternary eutectic alloys have lower cost than conventional nickel base superalloys, due to no expensive refractory elements. The ternary eutectic alloys have lower density than conventional nickel base superalloys. Minimum dendritic segregation during solidification, this eliminates concerns with macro/micro segregation and enables processing by cast and wrought techniques. The ternary eutectic alloys are microstructurally stable at elevated temperatures and therefore there is no precipitation of undesirable TCP phases and the equilibrium phases are stable at all temperatures up to the melting point. The ternary eutectic alloys have greatly enhanced tensile strength and creep strength compared to conventional polycrystalline nickel base superalloys due to increased Orowan strengthening, solid solution strengthening is relatively minor. The ternary eutectic alloys have high volume fraction of intermetallic strengthening phases, approximately 28 to 45 vol % delta phase precipitates and 30 to 35 vol % gamma prime phase precipitates.

Figure 3:
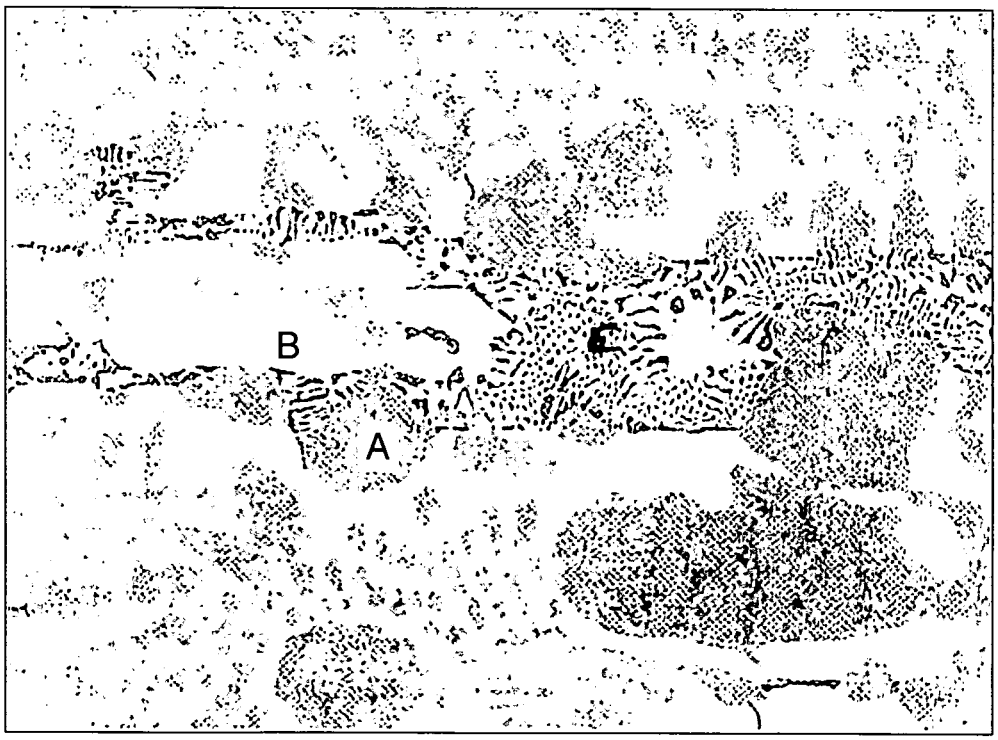
FIG. 3 is a micrograph of a ternary nickel eutectic alloy according to the present invention.

FIG. 3 shows a micrograph of the typical structure of a ternary nickel eutectic alloy according to the present invention. The gamma phase A, the gamma prime phase B and the delta phase C are clearly shown.

Figure 4:
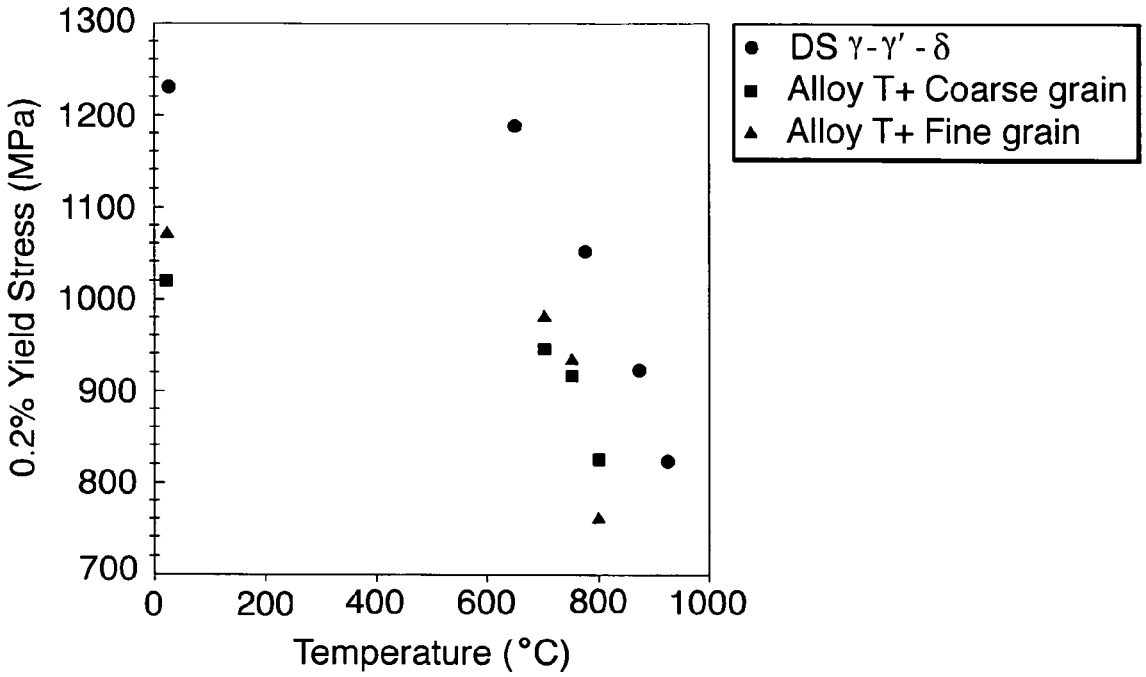
FIG. 4 is graph a comparing the tensile response of a directionally solidified ternary nickel eutectic alloy and a conventional nickel base superalloy at various temperatures.

FIG. 4 is a graph comparing the tensile response of a ternary nickel eutectic alloy according to the present invention and a conventional nickel base superalloy. In particular it compares the 0.2% yield stress in MPa at various temperatures up to 1000° C. for a directionally solidified ternary nickel eutectic alloy according to the present invention and alloy T+ with fine grains and alloy T+ with coarse grains. Alloy T+ is a nickel base superalloy described in our European patent EP1193321B1. It is clear from this graph that the ternary nickel eutectic alloy has much better yield stress at room temperature and at higher temperatures, 600° C. to 1000° C. This shows that the ternary nickel eutectic alloy may operate at higher temperatures.

Figure 5:
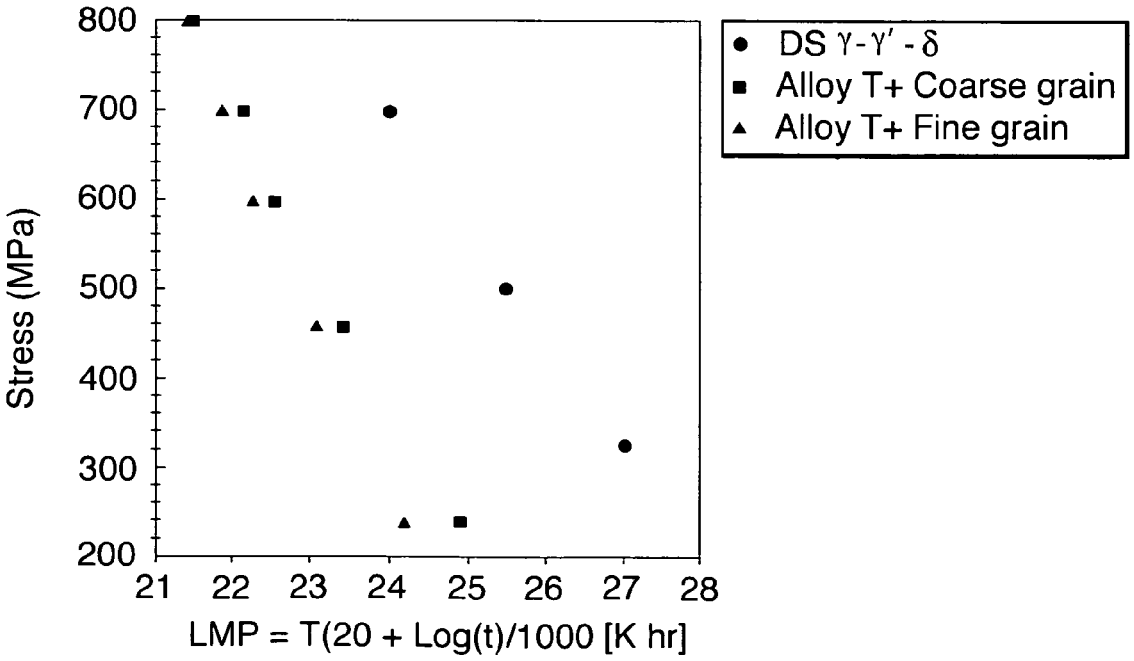
FIG. 5 is a graph comparing the creep response of a directionally solidified ternary nickel eutectic alloy and a conventional nickel base superalloy.

FIG. 5 is a graph comparing the creep response of a ternary nickel eutectic alloy according to the present invention and a conventional nickel base superalloy. In particular it plots the stress in MPa against LMP, where LMP=T(20+Log(t))/1000[K hr] and T=temperature and t=time, for a directionally solidified ternary nickel eutectic alloy according to the present invention and alloy T+ with fine grains and alloy T+ with coarse grains. It is clear from this graph that the ternary nickel eutectic alloy has much better creep response.

The addition of small amounts of grain boundary segregating elements, such as boron and/or carbon may be added to the ternary nickel eutectic alloys to improve the limited tensile ductility. The presence of these grain boundary segregating elements are known to reduce grain boundary diffusion, increase grain boundary cohesion and reduce grain boundary surface energy. The addition of chromium to the ternary eutectic alloys to increase oxidation and/or corrosion resistance and chromium is known to segregate to the gamma phase.

A ternary nickel eutectic alloy according to a broad range of the present invention consists of 4.5 to 11 wt % chromium, 0 to 6 wt % cobalt, 1 to 4 wt % aluminium, 0 to 1.5 wt % titanium, 0 to 3 wt % tantalum, 16 to 22 wt % niobium, 0 to 3 wt % molybdenum, 0 to 4 wt % tungsten, 0 to 1 wt % hafnium, 0 to 0.1 wt % zirconium, 0 to 0.1 wt % silicon, 0.01 to 0.1 wt % carbon, 0 to 0.01 wt % boron and the balance nickel plus incidental impurities.

A ternary nickel eutectic alloy according to an intermediate range of the present invention consists of 5 to 10 wt % chromium, 0 to 6 wt % cobalt, 1 to 3 wt % aluminum, 0 to 1.5 wt % titanium, 0 to 3 wt % tantalum, 18 to 22 wt % niobium, 0 to 3 wt % molybdenum, 0 to 4 wt % tungsten, 0 to 1 wt % hafnium, 0 to 0.1 wt % zirconium, 0 to 0.1 wt % silicon, 0.01 to 0.1 wt % carbon, 0 to 0.01 wt % boron and the balance nickel plus incidental impurities.

A ternary nickel eutectic alloy according to a narrow range of the present invention consists of 5.5 to 9.5 wt % chromium, 0 to 6 wt % cobalt, 1 to 2.5 wt % aluminium, 0 to 1.5 wt % titanium, 0 to 3 wt % tantalum, 18 to 22 wt % niobium, 0 to 3 wt % molybdenum, 0 to 4 wt % tungsten, 0 to 1 wt % hafnium, 0 to 0.1 wt % zirconium, 0 to 0.1 wt % silicon, 0.01 to 0.1 wt % carbon, 0 to 0.01 wt % boron and the balance nickel plus incidental impurities.

The present invention provides six examples of ternary nickel eutectic alloy.

Alloy V204A consists of 6.0 wt % chromium, 2.5 wt % aluminium, 20.5 wt % niobium, 0.01 wt % carbon and the balance nickel plus incidental impurities.

Alloy V204B consists of 6.0 wt % chromium, 2.5 wt % aluminium, 3 wt % tantalum, 18 wt % niobium, 0.03 wt % carbon, 0.005 wt % boron and the balance nickel plus incidental impurities.

Alloy V204C consists of 9.1 wt % chromium, 1.0 wt % aluminium, 20.1 wt % niobium, 0.06 wt % carbon and the balance nickel plus incidental impurities.

Alloy V204D consists of 5.9 wt % chromium, 2.5 wt % aluminium, 0.2 wt % titanium, 2.5 wt % tantalum, 19.5 wt % niobium, 0.03 wt % carbon, 0.005 wt % boron and the balance nickel plus incidental impurities.

Alloy V204E consists of 5.9 wt % chromium, 2.5 wt % aluminium, 2.5 wt % tantalum, 22.0 wt % niobium, 0.03 wt % carbon, 0.005 wt % boron and the balance nickel plus incidental impurities.

Alloy V204F consists of 5.6 wt % chromium, 2.3 wt % aluminium, 2.2 wt % tantalum, 20.0 wt % niobium, 1.6 wt % tungsten, 0.03 wt % carbon, 0.005 wt % boron and the balance nickel plus incidental impurities.

Two of the alloys, V204A and V204C, have no tantalum and four of the alloys, V204B, V204D, V204E and V204F, have tantalum in the range of 2 to 3 wt %.

The ternary nickel eutectic alloys of the present invention may be used for turbine discs, compressor discs, turbine blades, turbine vanes, turbine casings, turbine shrouds etc.

The invention claimed is:

1. A ternary nickel eutectic alloy consisting of 4.5 to 11 wt % chromium, 0 to 6 wt % cobalt, 1 to 4 wt % aluminium, 0 to 1.5 wt % titanium, 0 to 3 wt % tantalum, 16 to 22 wt % niobium, 0 to 3 wt % molybdenum, 0 to 4 wt % tungsten, 0 to 1 wt % hafnium, 0 to 0.1 wt % zirconium, 0 to 0.1 wt % silicon, 0.01 to 0.1 wt % carbon, 0 to 0.01 wt % boron and the balance nickel plus incidental impurities, the alloy comprising a gamma phase, a gamma prime phase that comprises $Ni_3Al$ and a delta phase that comprises $Ni_3Nb$, wherein aluminium in the gamma prime phase is optionally substituted with titanium or tantalum.

2. The ternary nickel eutectic alloy as claimed in claim 1 consisting of 5 to 10 wt % chromium, 0 to 6 wt % cobalt, 1 to 3 wt % aluminium, 0 to 1.5 wt % titanium, 0 to 3 wt % tantalum, 18 to 22 wt % niobium, 0 to 3 wt % molybdenum, 0 to 4 wt % tungsten, 0 to 1 wt % hafnium, 0 to 0.1 wt % zirconium, 0 to 0.1 wt % silicon, 0.01 to 0.1 wt % carbon, 0 to 0.01 wt % boron and the balance nickel plus incidental impurities.

3. The ternary nickel eutectic alloy as claimed in claim 2 consisting of 5.5 to 9.5 wt % chromium, 0 to 6 wt % cobalt, 1 to 2.5 wt % aluminium, 0 to 1.5 wt % titanium, 0 to 3 wt % tantalum, 18 to 22 wt % niobium, 0 to 3 wt % molybdenum, 0 to 4 wt % tungsten, 0 to 1 wt % hafnium, 0 to 0.1 wt % zirconium, 0 to 0.1 wt % silicon, 0.01 to 0.1 wt % carbon, 0 to 0.01 wt % boron and the balance nickel plus incidental impurities.

4. The ternary nickel eutectic alloy as claimed in claim 3 consisting of 6.0 wt % chromium, 2.5 wt % aluminium, 20.5 wt % niobium, 0.01 wt % carbon and the balance nickel plus incidental impurities.

5. The ternary nickel eutectic alloy as claimed in claim 3 consisting of 6.0 wt % chromium, 2.5 wt % aluminium, 3 wt % tantalum, 18 wt % niobium, 0.03 wt % carbon, 0.005 wt % boron and the balance nickel plus incidental impurities.

6. The ternary nickel eutectic alloy as claimed in claim 3 consisting of 9.1 wt % chromium, 1.0 wt % aluminium, 20.1 wt % niobium, 0.06 wt % carbon and the balance nickel plus incidental impurities.

7. The ternary nickel eutectic alloy as claimed in claim 3 consisting of 5.9 wt % chromium, 2.5 wt % aluminium, 0.2 wt % titanium, 2.5 wt % tantalum, 19.5 wt % niobium, 0.03 wt % carbon, 0.005 wt % boron and the balance nickel plus incidental impurities.

8. The ternary nickel eutectic alloy as claimed in claim 3 consisting of 5.9 wt % chromium, 2.5 wt % aluminium, 2.5 wt % tantalum, 22.0 wt % niobium, 0.03 wt % carbon, 0.005 wt % boron and the balance nickel plus incidental impurities.

9. The ternary nickel eutectic alloy as claimed in claim 3 consisting of 5.6 wt % chromium, 2.3 wt % aluminium, 2.2 wt % tantalum, 20.0 wt % niobium, 1.6 wt % tungsten, 0.03 wt % carbon, 0.005 wt % boron and the balance nickel plus incidental impurities.

10. The ternary nickel eutectic alloy as claimed in claim 1, wherein the delta phase and the gamma phase form lamellar structures and the gamma prime phase forms discrete precipitates in the gamma phase.

11. The ternary nickel eutectic alloy as claimed in claim 1 comprising 28 to 45 vol % delta phase precipitates and 30 to 35 vol % gamma prime phase precipitates.

12. The ternary nickel eutectic alloy as claimed in claim 1, wherein aluminium in the gamma prime phase is substituted with titanium or tantalum.

13. The ternary nickel eutectic alloy as claimed in claim 1, wherein the ternary nickel eutectic alloy is a pseudo ternary nickel eutectic alloy based on a nickel-aluminium-chromium-niobium system.

* * * * *